US010150658B1

(12) United States Patent
Benson et al.

(10) Patent No.: US 10,150,658 B1
(45) Date of Patent: Dec. 11, 2018

(54) DOWN WELL PUMP PULLER

(71) Applicant: Energyneering Solutions, Inc., Sisters, OR (US)

(72) Inventors: Benny Benson, Sisters, OR (US); Chadbourne Lovegren, Sisters, OR (US); William Song, Sisters, OR (US); Nick Fornalski, Sisters, OR (US)

(73) Assignee: Energyneering Solutions, Inc., Sisters, OR (US)

( * ) Notice: Subject to any disclaimer, the term of this patent is extended or adjusted under 35 U.S.C. 154(b) by 304 days.

(21) Appl. No.: 15/156,358

(22) Filed: May 17, 2016

Related U.S. Application Data

(60) Provisional application No. 62/172,051, filed on Jun. 6, 2015.

(51) Int. Cl.
*B66D 1/60* (2006.01)
*E21B 19/00* (2006.01)
*B66D 1/08* (2006.01)

(52) U.S. Cl.
CPC ..... *B66D 1/60* (2013.01); *B66D 1/08* (2013.01); *E21B 19/00* (2013.01)

(58) Field of Classification Search
CPC ... B66D 1/28; B66D 1/60; B66D 3/18; B66D 3/26
USPC ..... 254/334, 338
See application file for complete search history.

(56) References Cited

U.S. PATENT DOCUMENTS 4,597,562 A * 7/1986 Joyce ..... B66F 19/00 254/334
4,706,939 A * 11/1987 Gagne ..... E03B 9/00 254/332
5,240,229 A * 8/1993 Timmons ..... B66C 23/203 254/335
5,562,534 A * 10/1996 McGough ..... A22B 5/06 452/125
5,971,363 A * 10/1999 Good ..... A01G 23/099 254/266
7,191,732 B2 * 3/2007 Neal, Jr. ..... A01K 5/0225 119/51.01
7,314,406 B2 * 1/2008 Bilinovich ..... A01K 5/00 452/185
7,458,563 B1 * 12/2008 Liu ..... A01M 31/02 254/334
8,511,433 B2 * 8/2013 Place ..... A01M 31/02 182/133
2003/0006403 A1 * 1/2003 Vetesnik ..... A62B 1/06 254/334
2010/0270522 A1 * 10/2010 Tjader ..... B66C 23/66 254/336

* cited by examiner

*Primary Examiner* — Emmanuel M Marcelo
(74) *Attorney, Agent, or Firm* — Hancock Hughey LLP

(57) ABSTRACT

A pump pulling apparatus that is adapted for attachment to a vertical LFG well for the purpose of moving a pump such as a dewatering pump up and down the well. The apparatus is an upright vertical column on which a reversible winch is mounted. The column may be secured to the wellhead and a cable attaches to the down-well pump and the winch is operable to lower the pump into the well and to raise the pump out of the well.

9 Claims, 8 Drawing Sheets

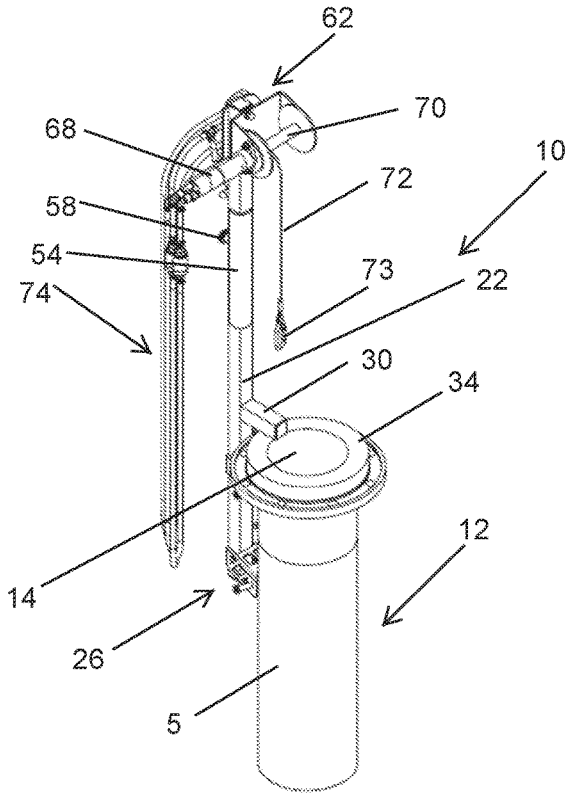
Fig. 1
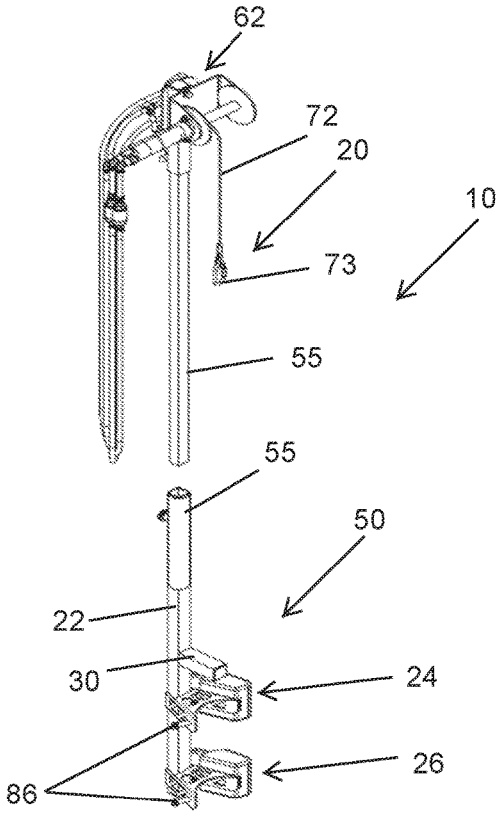
Fig. 2
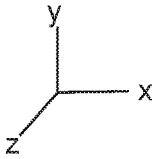

DOWN WELL PUMP PULLER

TECHNICAL FIELD

The present invention relates to apparatus and methods for extracting pumps from remote locations, and more particularly to apparatus adapted to remove a down-well pump such as a de-watering pump from an existing vertical landfill gas (LFG) extraction well.

BACKGROUND

Landfills are often prolific contributors of greenhouse gases, particularly methane (CH4), which according to the EPA, is a greenhouse gas that is approximately 21 times more potent than carbon dioxide (CO2). As a byproduct of waste disposal and aerobic and anaerobic digestion by microbes of organic matter, landfills produce a variety of gases, including methane and carbon dioxide and others. Some of these gases, typically composed of mostly methane and carbon dioxide, may be collected in compliance with state and federal regulations and combusted in a flare system. However, methane, in particular, may be utilized with contemporary technology to generate electricity by combustion, fuel industrial boilers, or be converted to pipeline quality High-BTU gas so there is inherent value in using methane. In addition to obvious economic advantages derived from using methane as a fuel, flaring methane from the landfill reduces greenhouse gas emissions relative to the situation where methane is neither utilized as a fuel nor flared.

Landfills frequently have gas extraction systems to capture landfill gases. The gases are typically drawn out of a landfill with a low pressure vacuum via a wellfield collection and control system (GCCS). The wellfield typically consists of multiple gas extraction wells that extend deep beneath the surface of the landfill to pull methane from a location near the bottom of the landfill. Each extraction well extends up to the surface of the landfill and is connected with other wells, creating a piping matrix, so that a vacuum can be pulled with one centralized blower or compressor.

Landfill gas extraction wells are perforated along their lengths to allow the gases to be extracted from the waste deposits. There are many factors that influence the effectiveness of a landfill gas extraction well. For example, liquid leachate often flows into the well pipes and there may be a liquid-level blockage that decreases the efficiency of gas extraction. In the instance of a high liquid level, a dewatering pump is often installed in the extraction well to remove the liquid and allow the vacuum to pull on the waste through the perforations again. Such down-well pumps are often used in LFG extraction wells to pump the liquid leachate from the bottom of the well, to the upper end of the well so that it may be disposed. This clears the liquid from the well and increases gas extraction efficiency.

A de-watering pump typically is attached to a lowering cable and includes an outflow pipe through which leachate is pumped out of the well. The pump is typically inserted into the well through the open, exposed end and is lowered with the lowering cable to the desired level by hand, using a lowering cable that is attached to the pump. Removal of the pump after the well has been de-watered is just the opposite: an operator pulls the pump out of the well by hand. But pulling a down-well de-watering pump from the well can be a difficult and time-consuming process. Not only is hand-pulling a pump out of a well an inefficient way to get a down-well pump into and out of a well pipe, but it can be dangerous (for instance, if the pump is dropped into the well in an uncontrolled manner), the process is slow (hand insertion and extraction is inefficient) and can lead to worker injuries. There is a need therefore for improved apparatus for lowering down-well pumps into LFG extraction wells, and extracting the pumps after de-watering is complete.

SUMMARY OF INVENTION

The subject invention is a pump pulling apparatus that is adapted for attachment to a vertical LFG well. The apparatus is a vertical column on which a reversible winch is mounted. The apparatus features a system for securely mounting the vertical column to the wellhead to insure a strong and stable connection to the wellhead. A cable attaches to the down-well pump and the winch is operable to lower the pump into the well and to raise the pump out of the well.

BRIEF DESCRIPTION OF THE DRAWINGS

The invention will be better understood and its numerous objects and advantages will be apparent by reference to the following detailed description of the invention when taken in conjunction with the following drawings.

FIG. 1 is a perspective view of a first embodiment of an assembled pump pulling apparatus according to the present invention, illustrated with the apparatus mounted on a well head cap.

FIG. 2 is a perspective and partially exploded view of the pump pulling apparatus according to the present invention and shown in FIG. 1, shown in isolation.

DETAILED DESCRIPTION OF ILLUSTRATED EMBODIMENTS

Figure 3:
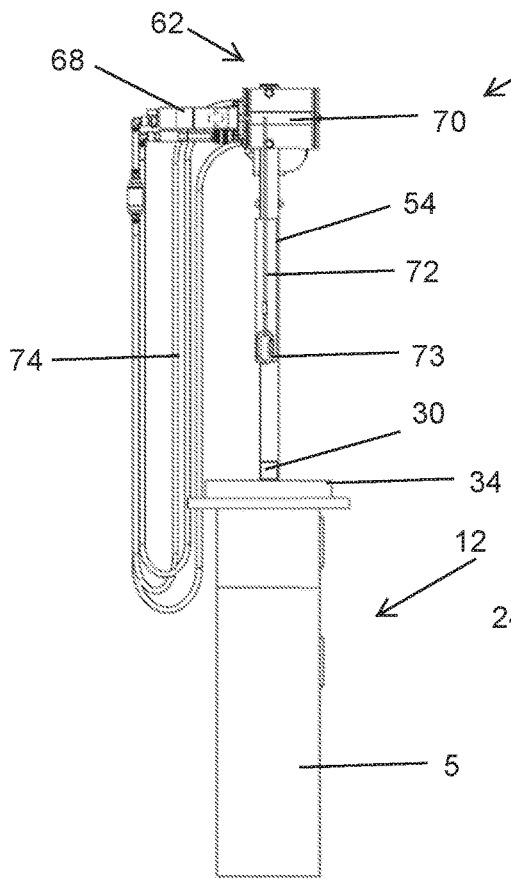
FIG. 3 is a front elevation view of the pump pulling apparatus shown in FIG. 1, mounted to the well head cap.

The invention will now be described in detail with reference to the drawings. Two embodiments of the present invention are illustrated, the first embodiment shown in FIGS. 1 through 7 and the second shown in FIGS. 8 through 14. The same referenced numbers are used in all of the drawings to refer to identical or analogous features of the invention described in the two different embodiments.

With reference now to the first embodiment of the invention shown in FIGS. 1 through 7, and with specific reference to FIG. 1, a first illustrated embodiment of a pump pulling apparatus 10 according to the present invention is illustrated in an assembled condition and in perspective view. In FIG. 1 the apparatus 10 is shown attached to a wellhead cap 12. The wellhead cap 12 is of course the upper end, above ground portion of a well casing defined by a vertical pipe 5 that extends into the ground—the cap 12 has an open end 14 through which a de-watering pump, which is not shown in the drawings, may be inserted.

Pump pulling apparatus 10 defines a vertically oriented elongate column that in a preferred embodiment comprises a lower column assembly 20 and an upper column assembly 50, both of which are detailed below and which are interconnected at a sleeve fitting 54. The lower column assembly 20 attaches apparatus 10 to wellhead cap 12 and the upper column assembly 50 supports the motor and winch assembly that serves to pull the de-watering pump from the well. While in the illustrated embodiment the elongate column of apparatus 10 is defined by upper and lower columns that are interconnected, the apparatus may be fabricated with a single column.

In normal use the apparatus 10 is mounted onto an existing wellhead cap 12 that is typically extending vertically relative to a nominally horizontal ground plane. As such, at times in this description the relative positions of structural components of the apparatus 10 are described using relative directional terms. In all cases, these terms are based upon the vertical orientation of apparatus 10 as it is positioned in a vertically oriented pipe 5. The upper or top end of the apparatus 10 is thus the upper end of the apparatus as shown in the view of FIG. 1. Other relative directional terms correspond to this convention: the "lower" or bottom end of the apparatus is opposite the upper end. "Inner" or "inward" refers to the structural center of the apparatus and the direction from the outer portions of the device toward the center of it, and so on. An X-Y-Z axis grid is shown in FIG. 1. The X-Y plane is defined as the plane transverse to the ground plane and thus the plane extending in the vertical direction—the apparatus travels in a well pipe 5 along an axis parallel to the Y direction. The Y-Z plane is the parallel to the ground plane and transverse to the X-Y plane.

Figure 5:
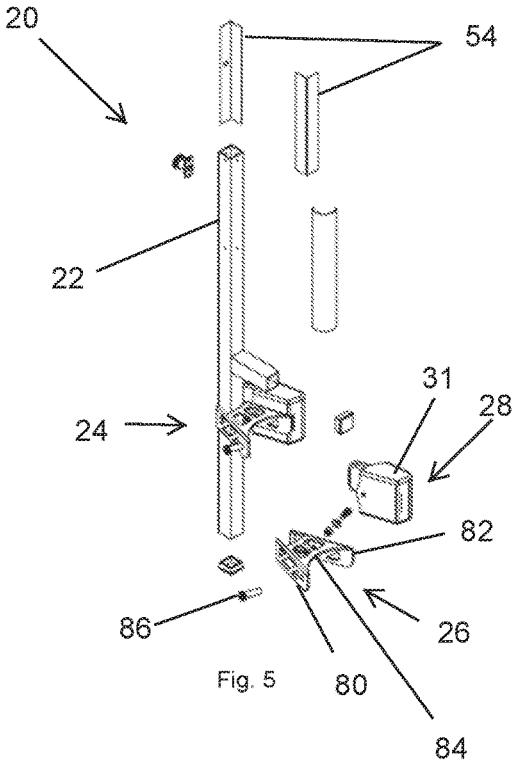
FIG. 5 is a perspective and exploded view of the lower end components of the pump pulling apparatus shown in FIG. 1.

Lower column assembly 20 will be described first with specific reference to FIGS. 2 and 5. The lower column assembly 20 comprises a vertically extending pipe or column 22, preferably rectangular in section as shown, that has an upper V-shaped pipe brace 24 and a lower V-shaped pipe brace 26 attached thereto near the lower end of the column 22. As seen in FIG. 1, the wellhead cap 12 is cylindrical; as such the V-shaped pipe braces 24 and 26 may be mounted over the pipe 5 to thereby attach the lower column assembly 20 to the wellhead cap 12. Each of the two pipe braces 24 and 26 has opposed V-arms, 80, 82, and a rounded base 84 that extends between and interconnects the opposed arms; when apparatus 10 is mounted to pipe 5 as shown in FIG. 1 the opposed arms 80 and 82 straddle and abut the pipe and the pipe, which is cylindrical, rests against the rounded base 84 between the arms 80 and 82. When combined with the strap system described below, the braces define a very secure mounting arrangement.

Other configurations for the braces 24 and 26 are possible instead of the generally V-shaped braces shown and described. For example, if the apparatus 10 will be used with a pipe 5 that has flattened outer walls the braces may have the arms configured in a flattened, linear arrangement, rather than the V-shaped arms, so that the arms butt against the flattened outer walls of the pipe.

Each of the two pipe braces 24 and 26 further includes a ratchet assembly 28 that has a retractable 29 strap (see, e.g., the side elevation view of FIG. 4 in which the straps 29 are shown) that may be extended from a ratchet base 31 (see FIG. 5), which is attached to arm 82. The strap extends around the pipe 5 with the end of the strap secured to the opposite side of the pipe brace by connection to, for instance, a connector pin 86 extending from arm 80. The ratchet base 31 includes a conventional ratchet for tightening the strap 29 to secure the lower column assembly 20 to pipe 5.

Other strapping devices may be used instead of the ratcheted straps described above to achieve the same result, that is, securing the lower column assembly to the wellhead.

A stop arm 30 is attached to the column 22, as best seen in FIGS. 1 and 2. Returning to FIG. 1, when the lower column assembly is mounted to the wellhead 12 the stop arm 30 extends over the upper edge 34 of cap 12 and the pipe stop thus functions to support the apparatus 10 on the cap 12. Specifically, when the apparatus 10 is secured to the cap 12 with the ratchet assemblies 26, 28, the stop arm 30 rests on the upper rim 34 of the cap 12, thereby providing vertical support for apparatus 10—the stop arm defines a vertical movement stop member that supports the weight of the apparatus 10. If desired, the stop arm 30 may be made vertically adjustable along column 22 with, for example, pins that extend through bores in the base of the pipe stop and aligned bores cooperatively spaced along column 22.

A sleeve 54 that is defined by a rectangular length of pipe is attached to the upper end of column 22 (for example, by welding, attaching with screws, etc.). The sleeve has slightly greater interior dimensions than the exterior dimensions of column 22 so that the sleeve slides snugly onto the upper end of the column. If the cross sectional configuration of the columns 22 and 55 is other than rectangular the sleeve 54 will of course conform to whatever cross sectional configuration is utilized for the columns to facilitate attachment of the upper and lower columns. And of course, the two upright column sections 22 and 55 may be combined into a unitary section rather than being segmented. As illustrated in the exploded view of FIG. 5, the sleeve 54 may be fabricated from multiple pieces.

Figure 6:
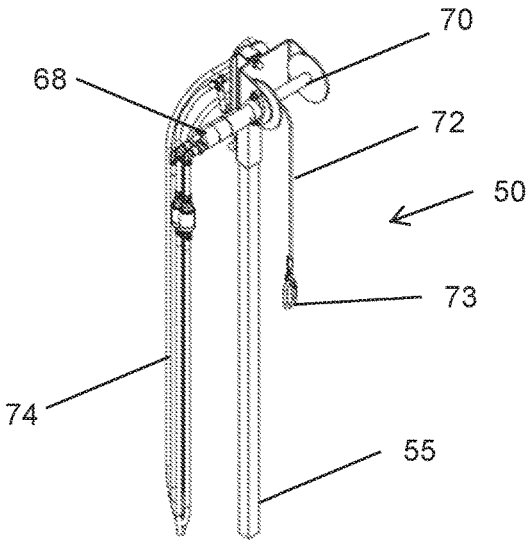
FIG. 6 is a perspective view of the upper end components of the pump pulling apparatus shown in FIG. 1.
Figure 7:
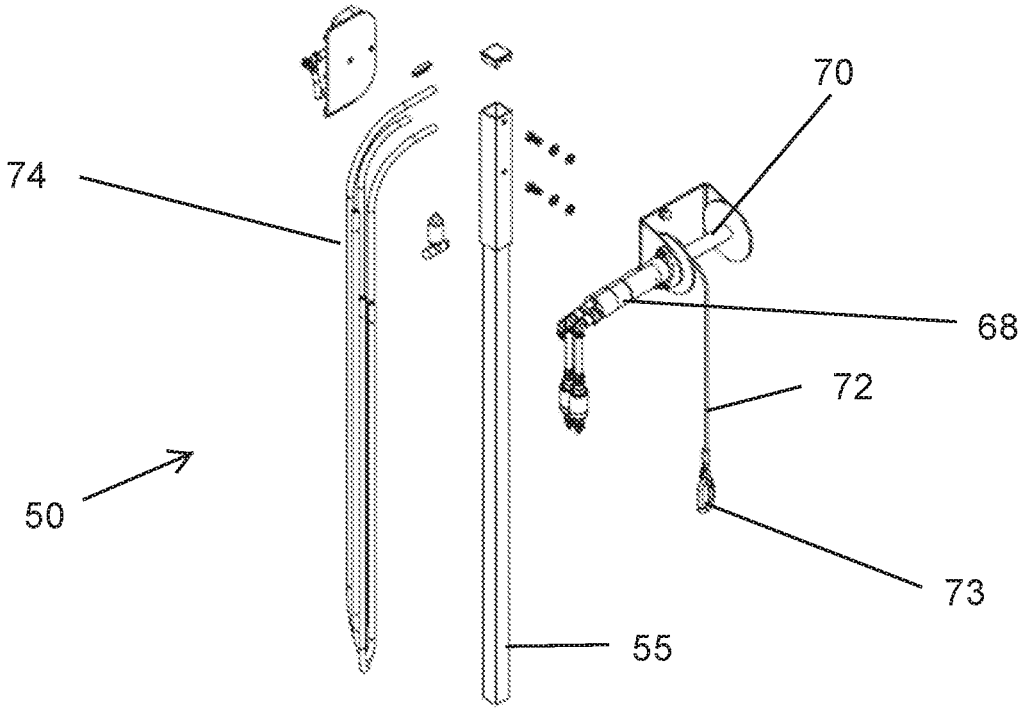
FIG. 7 is a perspective and exploded view of the upper end components of the pump pulling apparatus shown in FIG. 6.
Figure 8:
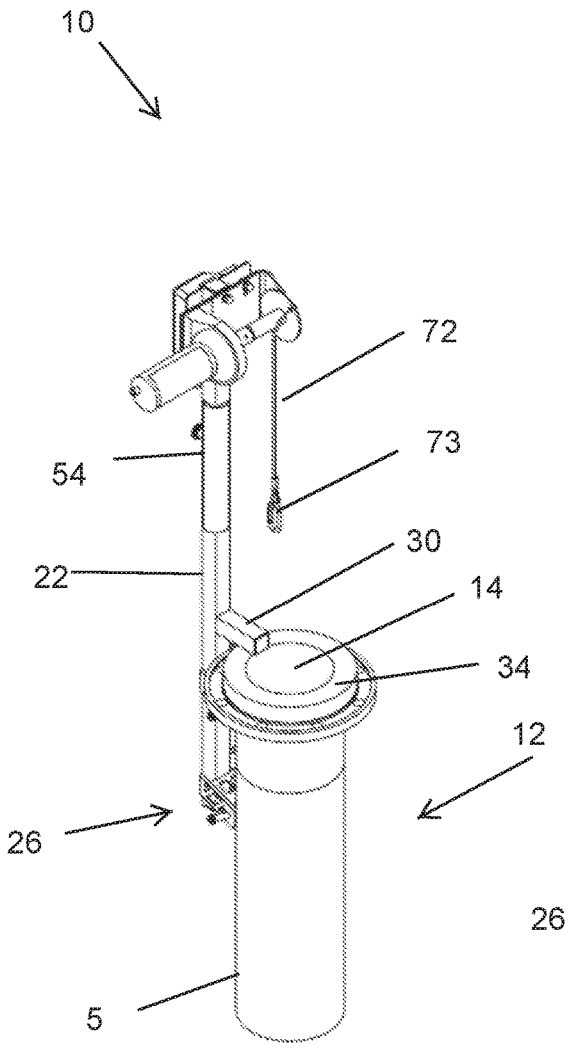
FIG. 8 is a perspective view of a second embodiment of an assembled pump pulling apparatus according to the present invention, illustrated with the apparatus mounted on a well head cap.
Figure 9:
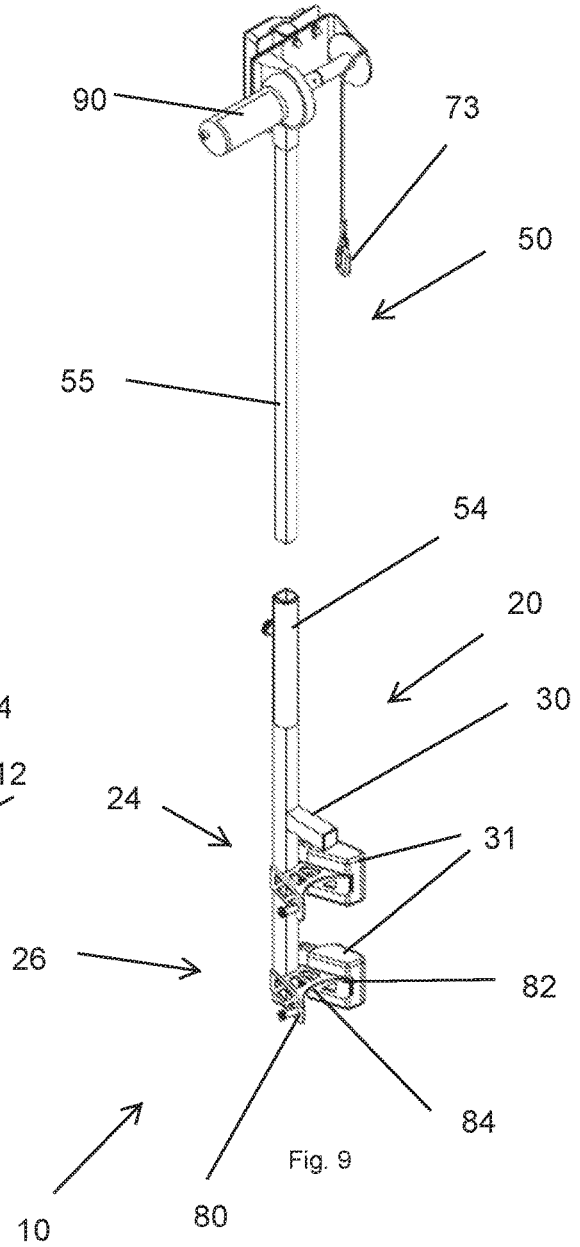
FIG. 9 is a perspective and partially exploded view of the pump pulling apparatus according to the second embodiment shown in FIG. 8, shown in isolation.
Figure 10:
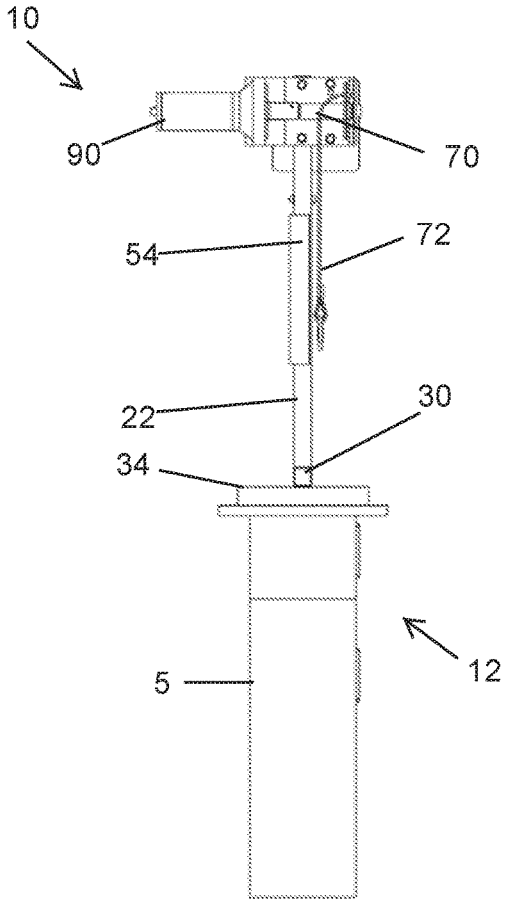
FIG. 10 is a front elevation view of the pump pulling apparatus shown in FIG. 8, mounted to the well head cap.
Figure 11:
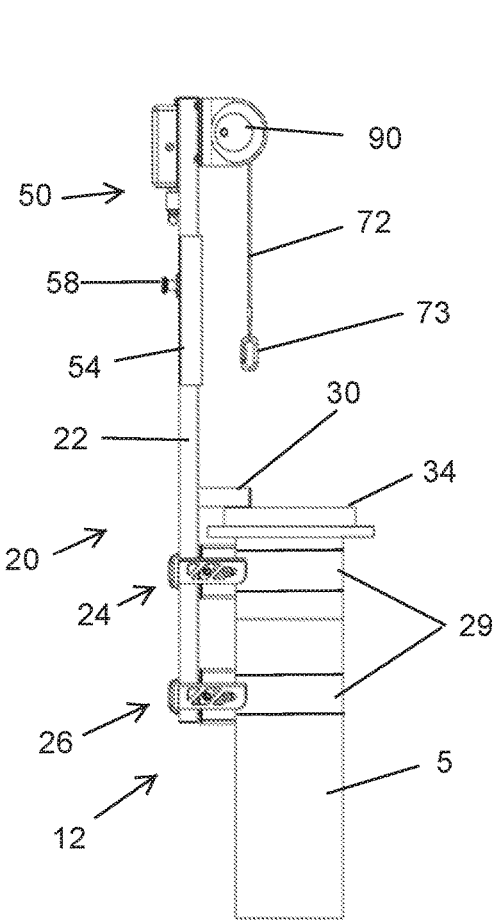
FIG. 11 is a side view of the pump pulling apparatus shown in FIG. 10.
Figure 12:
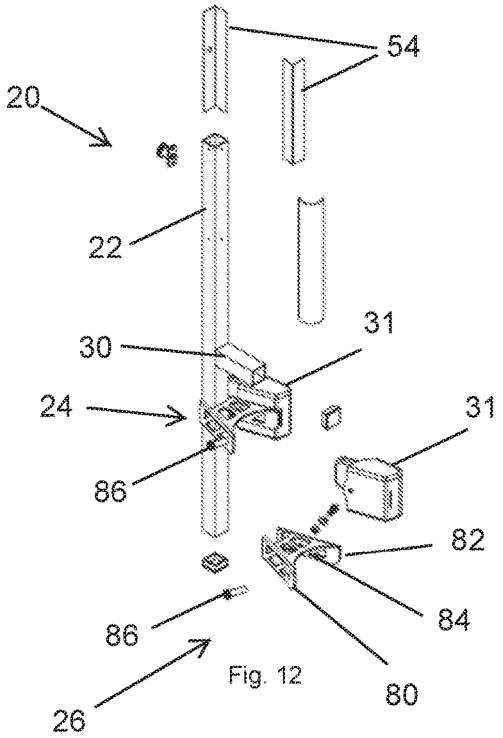
FIG. 12 is a perspective and exploded view of the lower end components of the pump pulling apparatus shown in FIG. 8.
Figure 13:
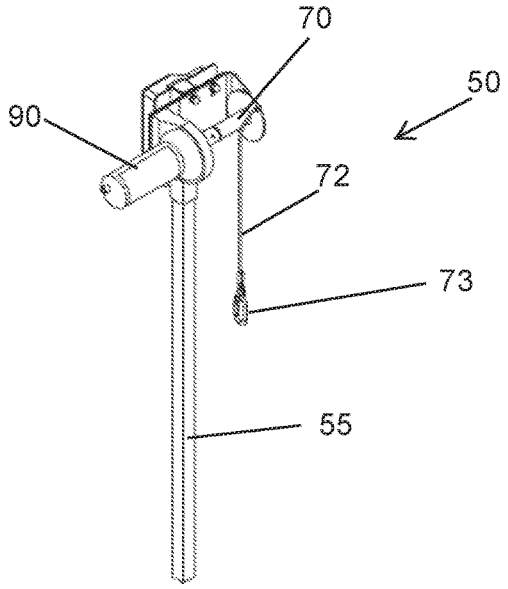
FIG. 13 is a perspective view of the upper end components of the pump pulling apparatus shown in FIG. 8.
Figure 14:
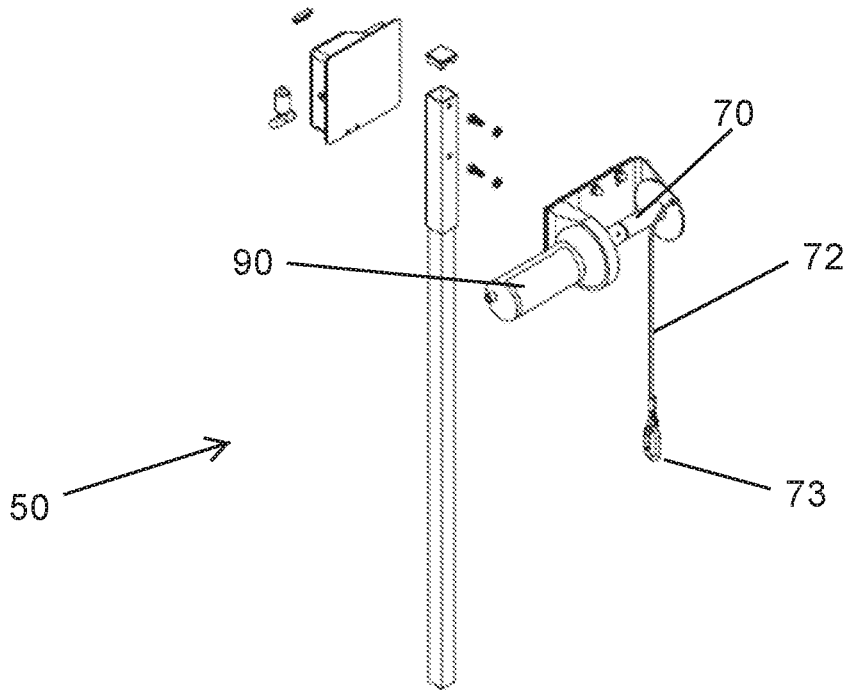
FIG. 14 is a perspective and exploded view of the upper end components of the pump pulling apparatus shown in FIG. 13.

The upper column assembly 50 is now described with particular reference to FIGS. 1, 6 and 7. The upper column 55 is a vertically extending pipe, preferably rectangular in section as shown and having the same dimensions as lower column 22. As noted above, sleeve 54 is a cooperatively shaped pipe with a slightly larger interior dimension than the dimensions of column 22 and is attached to the upper end of lower column 22. The sleeve 54 allows the interconnection and between lower column assembly 20 and upper column assembly 50. Specifically, the lower end of column 55 is inserted into the upper (open) end of sleeve 54 and the column is slid into the sleeve until the lower end of column 55 abuts the upper end of column 22. A thumb screw 58 may be threaded through sleeve 54 so that the thumb screw may be rotated to drive the distal end of the screw shaft against the column 55 to secure the column to the sleeve 54. The two column sections, lower column assembly 20 and upper column assembly 50 define a stable column when they are in the position shown in FIG. 1 by virtue of the interconnection provided by sleeve 54, which as noted, receives the lower column. The multi-component fabrication allows the upper and lower column assemblies to be easily disconnected for transport.

Figure 4:
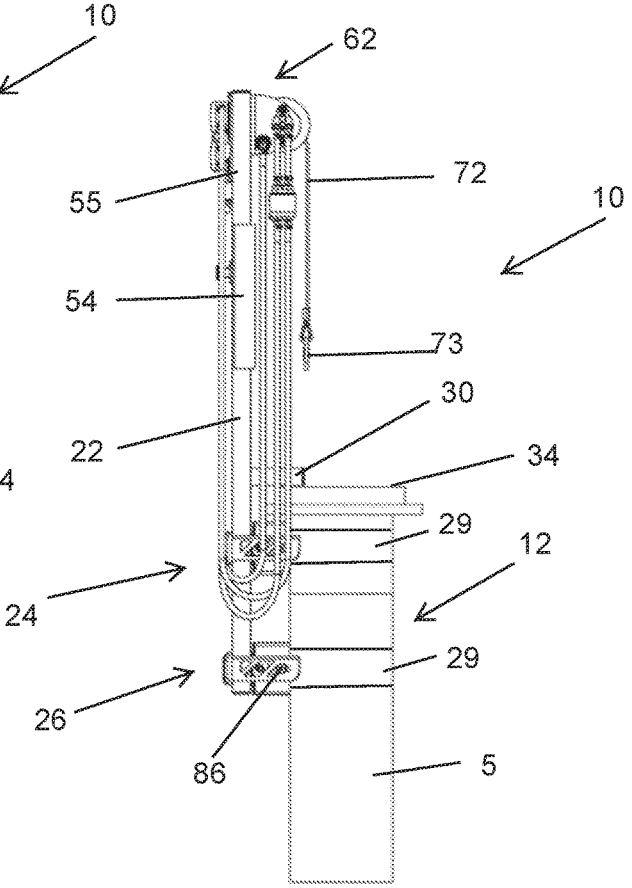
FIG. 4 is a side view of the pump pulling apparatus shown in FIG. 3.

A motor and winch assembly 62 is mounted to the upper end 64 of upper column 55 with appropriate mounting brackets, as best illustrated in FIGS. 1, 3 and 4. In the embodiment of FIGS. 1 through 7, the winch assembly includes a pneumatic motor/gearbox 68, a cable drum 70 around which a cable 72 is wound. It will be appreciated while for simplicity only a short portion of the cable 72 is shown, a sufficient length of suspension cable 72 is wrapped around cable axle 70 in order to have the dew-watering pump reciprocated into the well to the desired depth. The free end of cable 72 has an appropriate clip such as a carabiner 73 attached thereto for attaching the de-watering pump to the cable. The pneumatic motor/gearbox includes conventional and appropriate pneumatic hoses 74 and appropriate pneumatic pumps. It also is preferably operable with a foot pedal (not shown) so that a technician may operate the winch in both directions with his or her foot. The use of a pneumatic motor/gearbox 68 is especially desirable for use with a pump puller 10 that may be used in an environment where there may be combustible gasses, as is sometimes the case with wells in landfills and the like.

The pump puller apparatus 10 is shown in an exploded position in FIG. 2—since the apparatus may be easily disassembled it allows for simple transportation of the apparatus to and from a job site. To disconnect the upper column assembly 50 from the lower column assembly 20 the thumb screw 58 is loosened and the column 55 is removed from sleeve 54.

A second embodiment of a pump puller apparatus 10 is shown in the series of drawings of FIGS. 8 through 14. With the exception of the type of motor/gearbox that is used, the components of the second embodiment are identical to the first embodiment described above. In the embodiment of FIGS. 8 through 14 the cable drum 70 is driven by an electric motor/gearbox 90. Electric motor/gearbox 90 is operably connected to cable drum 70, which except for the type of motor that drives the cable drum, includes a cable 72 as described above in respect of the prior embodiment. The electric motor/gearbox 90 of course requires an electrical connection from a source of power, such as grid power or power supplied by a generator. It also is preferably operable with a foot pedal (not shown) so that a technician may operate the winch in both directions with his or her foot.

The pump puller apparatus described above is light and easily transported to a job site where it may be attached to a well head. The apparatus is attached to the well head cap 12 as follows. Initially, the lower column assembly 20, which is detached from the upper column assembly 50, is position adjacent the well pipe 12 with the two V-shaped pipe braces 24 and 26 straddling the pipe 5 as shown in FIGS. 1, 4, 8 and 11 and such that the stop arm 30 is resting on the upper rim 34 of the wellhead cap 12. The retractable strap 28 from each of the V-shaped pipe braces 24 and 26 is extended and wrapped around the pipe 5 and the end of the straps is secured to the opposite leg of the V-shaped pipe brace. The ratchet mechanism is then used to tighten the straps securely.

The upper column assembly 50 is then connected to the lower column assembly 20 by inserting the lower end of column 55 into sleeve 54 and securing the thumb screw 58.

A pump may then be attached to carabiner 73 and the apparatus 10 may be operated to drop the pump into the well pipe 5, and to withdraw the pump from the pipe.

While the present invention has been described in terms of preferred and illustrated embodiments, it will be appreciated by those of ordinary skill that the spirit and scope of the invention is not limited to those embodiments, but extends to the various modifications and equivalents as defined in the appended claims.

The invention claimed is:

1. A pump puller for mounting to a well having a wellhead with an open end, comprising:

an elongate column;

first and second V-shaped braces attached to the elongate column at a lower portion thereof such that the first V-shaped brace is spaced apart from the second V-shaped brace, each of the first and second V-shaped braces having first and second arms interconnected with a curved base, wherein the first V-shaped brace has an adjustable strap attached to the first arm and a connector attached to the second arm, and the second V-shaped brace has an adjustable strap attached to the first arm—and a connector attached to the second arms, wherein each strap has a distal end, and each connector is adapted for engaging the distal end of a strap and for tightening the strap when the distal end of each strap is engaged with the connector;

a stop attached to the elongate column above the first and second braces such that the stop is configured to extend over the open end of the wellhead when the elongate column is mounted thereto; and a winch attached to the elongate column.

2. The pump puller according to claim 1 including a first ratchet associated with the first connector and adapted to tighten the first strap and a second ratchet associated with the second connector and adapted to tighten the second strap.

3. The pump puller according to claim 1 including a motor for driving the winch and wherein the motor is a pneumatic motor.

4. A pump puller for mounting to a well having a wellhead with an open end, comprising:

an upright support member having an upper end and a lower end;

a winch mounted to the support member and a motor for driving the winch;

an arm extending transversely from the upright support member proximate the lower end thereof;

a first V-shaped brace mounted to the upright support member between the arm and the lower end of the upright support member, the first V-shaped brace having first and second arms extending from a rounded base, a first adjustable strap attached to one of the arms, and a first connector attached to the second of the arms; and a second V-shaped mounted to the upright support member between the first V-shaped brace and the lower end of the upright support member, the second V-shaped brace having first and second arms extending from a rounded base, a second adjustable strap attached to one of the arms, and second connector attached to the second of the arms.

5. The pump puller according to claim 4 in which each of the first and second adjustable straps is extendable from a retracted position to an extended position in which a distal end of each strap may be attached to a connector.

6. The pump puller according to claim 5 including a first ratchet associated with the first connector and a second ratchet associated with the second connected, wherein each ratchet is adapted for tightening the strap.

7. The pump puller according to claim 4 wherein the motor is a pneumatic motor.

8. A pump puller for mounting to a well having a wellhead with an open end, comprising:

an upright support member defined by an upper section and a lower section, the upper and lower sections interconnected;

a winch and a motor for driving the winch, the winch and motor mounted to the upper section of the upright support member;

a stop arm attached to and extending transversely from the upright support member;

a first V-shaped brace mounted to the lower section below the stop arm, the first V-shaped brace having first and second arms interconnected with a curved base member, a first strap attached to one of the arms, and a connector attached to the second of the arms, and tightening means for tightening the first strap when a distal end of the first strap is attached to the connector;

a second V-shaped brace mounted to the lower section below the first V-shaped brace, the second V-shaped brace having first and second arms interconnected with a curved base member, a second strap attached to one of the arms, and a connector attached to the second of the arms; and tightening means for tightening the second strap when a distal end of the second strap is attached to the connector.

9. The pump puller according to claim 8 in which the motor is a pneumatic motor.

* * * * *